US006652681B2

(12) United States Patent
Delabroy et al.

(10) Patent No.: US 6,652,681 B2
(45) Date of Patent: Nov. 25, 2003

(54) METHOD OF REHEATING METALLURGICAL PRODUCTS

(75) Inventors: Olivier Delabroy, Paris (FR); Rémi Tsiava, St Germain les Corbeil (FR); Gérard Le Goueffec, Magny les Hameaux (FR); Fouad Ammoury, Massy (FR)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/948,037

(22) Filed: Sep. 7, 2001

(65) Prior Publication Data

US 2002/0050670 A1 May 2, 2002

(30) Foreign Application Priority Data

Sep. 8, 2000 (FR) ..... 00 11480

(51) Int. Cl.[7] ..... C21D 11/00; C21D 1/34
(52) U.S. Cl. ..... 148/663; 148/559; 148/579
(58) Field of Search ..... 148/633, 579, 148/559

(56) References Cited

U.S. PATENT DOCUMENTS 5,688,339 A 11/1997 Farmer et al.
6,171,100 B1 * 1/2001 Joshi et al. ..... 431/182
6,250,916 B1 * 6/2001 Philippe et al. ..... 432/29
6,454,562 B1 * 9/2002 Joshi et al. ..... 432/17

FOREIGN PATENT DOCUMENTS

| | | |
|---|---|---|
| EP | 1 001 237 A1 | 5/2000 |
| FR | 2.046.595 | 3/1971 |
| JP | 9-263836 | 10/1997 |

OTHER PUBLICATIONS

Search Report issued in French Application No. 00 11480.

* cited by examiner

*Primary Examiner*—Deborah Yee
(74) *Attorney, Agent, or Firm*—Burns, Doane, Swecker & Mathis, L.L.P.

(57) ABSTRACT

Method of reheating metallurgical products, in which solid products, especially steel products, are reheated so as to bring them from a temperature substantially below 400° C. to a temperature of at least about 1000° C. by passing them through a furnace having an upstream zone in which the said products are preheated and a downstream zone in which the said products are brought to their final temperature on leaving the furnace, the downstream zone of the furnace being fitted with burners, at least some of which operate with an oxidizer which is air, the smoke (flue gases) generated by these burners flowing as a countercurrent to the products and preheating these products in the upstream preheating zone. According to the invention, at least one burner is placed in the upstream preheating zone of the furnace, this burner being fed with a mixture of oxidizer and fuel, the oxidizer containing more than 21 vol % and preferably more than 30 vol % oxygen.

35 Claims, 10 Drawing Sheets

METHOD OF REHEATING METALLURGICAL PRODUCTS

The present invention relates to a method of reheating metallurgical products, in which solid products, especially steel products, are reheated so as to bring them from a temperature substantially below 400° C. to a temperature of at least about 1000° C. by passing them through a furnace having an upstream zone in which the said products are preheated and a downstream zone in which the said products are brought to their final temperature on leaving the furnace, the downstream zone of the furnace being fitted with burners, at least some of which operate with an oxidizer which is air, the smoke (flue gases) generated by these burners flowing as a countercurrent to the products and preheating these products in the upstream preheating zone (the terms "smoke" or "flue gases" are hereafter used with the same meaning).

DESCRIPTION OF THE RELATED ART

Reheat furnaces are used in the steel industry to reheat steel products coming especially from continuous casting and to bring them to the rolling temperature which is around 1000to 1300° C.

Furnaces of this type usually consist of several successive zones. Starting from the charge end (in the direction in which the products run through the furnace), these successive zones are the upstream zone called the flue gases exhaust (or recovery) zone in which the thermal energy of the flue gases, which is produced downstream in the furnace and which flows as a countercurrent to the products to be reheated, is recovered in order to start to preheat these products.

This preheating zone is followed by one or more heating zones, the furnace terminating in an equalization (or soaking) zone which serves to ensure that the temperature of the product leaving the furnace is homogeneous. Burners may be preferably installed on each side of the product which travels from the preheating zone to the end of the heating zones. Such burners may also be placed in the roof of the furnace (radiant roof case) or else in recesses depending on the width of the furnace.

While the products are passing through the various successive zones of the reheat furnace, the temperature of the product at the surface and inside it progressively increases. Owing to the characteristic times for thermal conduction, especially in steel, there is a temperature difference between the top side of the product and the underside or else between the top side of the product and the core of the product. Controlling these thermal inhomogeneities is an important aspect of the invention.

This problem of obtaining temperature homogeneity of the product is all the greater the more limited the thermal power that can be injected into a reheat furnace. There may be several reasons for this limitation: the limited volume of smoke, temperature of one or more zones of the furnace at maximum, temperature at the inlet of the energy recuperator at maximum, etc. In all cases, the limitation in injected thermal power results in a limitation in the energy transferred to the product and therefore to thermal inhomogeneities throughout the mass of the product appearing or increasing. In order to provide a better explanation of the problem facing a person skilled in the art, FIG. 1 shows the curve of how the temperature difference ΔT (defined below) varies as the product is being reheated.

For a furnace in which the products rest on the hearth, the temperature difference ΔT will be the difference between the temperature of the top side of the product exposed to the radiation of the furnace and the temperature of the underside of the product in contact with the hearth.

For a walking beam furnace, that is to say one in which the hot gases of the furnace circulate all around the product, the temperature difference ΔT will be the difference between the surface temperature and the core temperature of the product.

In FIG. 1, the position of the product in the furnace has been plotted on the x-axis and the ΔT value on the y-axis. The initial temperature difference ($\Delta T_{init}$) may be zero, when the product is at room temperature at the charge end of the furnace, or non-zero in the case of products whose temperature has not yet become homogeneous again, for example in the case of the treatment of metallurgical products shortly after their production. In FIG. 1, X represents the position of the product in the furnace, 0 being the charge end where the products enter the furnace, while $X_B$ is the discharge end or exit of the furnace.

The curve (C) showing the variation of ΔT as a function of X in FIG. 1 has a point A where the parameter ΔT reaches a maximum ($\Delta T_{max}$), a point D where the parameter ΔT has a value $\Delta T_{init}$, which is the value of ΔT of the product at the charge end and a point B where the parameter ΔT has a value $\Delta T_{final}$ of the product at the exit (discharge end) of the furnace.

Somewhere in the middle of the furnace, at the point $X_A$, the temperature difference ΔT reaches its maximum ($\Delta T_{max}$). This $\Delta T_{max}$ value must be as small as possible, since a large temperature difference is equivalent to deformations (bending) of the product which may result in the product being damaged or in the furnace not being able to be operated or in the product leaving the furnace not being able to be rolled. Thus, in certain furnaces the operators must limit the power of the furnace and/or its production in order to avoid the appearance of excessively large temperature differences ΔT. This is a major drawback for an industrialist.

It is therefore a first object of the present invention to prevent the appearance of excessively large temperature differences in the product throughout the time it is passing through the furnace.

FIG. 2 illustrates the relationship between the temperature difference ΔT and the sag, that is to say the vertical deformation, of the product during its passage through the furnace.

This FIG. 2 shows the curve (C), as in FIG. 1, and a curve (F) which represents the vertical deformation of the product as a function of X. It may be seen that the maximum deformation corresponds approximately to the maximum ΔT ($\Delta T_{max}$ for $X=X_A$).

Moreover, it has been shown that another important parameter is the temperature difference $\Delta T_{final}$ at the exit of the furnace. Ideally, $\Delta T_{final}$ should be zero at the exit (discharge end) of the furnace. In practice, a certain temperature difference $\Delta T_{final}$ is tolerated, but it must not exceed about 100° C. in the case of billets and 200° C. in the case of slabs and blooms. This is because a large temperature difference causes rolling difficulties which may result in mechanical hitches in certain stands of the rolling mill. In addition, any temperature inequality is manifested by a reduction in quality of the finished product.

It is also an object of the present invention to reduce $\Delta T_{final}$ of a product exiting a reheat furnace without increasing the consumption of energy in the furnace.

The article entitled *"Efficient operation of continuous reheat furnaces through oxygen optimization of combustion*

*system"* by G. Gitman, T. Wechler and B. Levinson, published in the journal *Industrial Heating,* describes various systems for reheating metallurgical products and suggests the use of oxy-fuel burners instead of the usual air-fuel burners, so as to increase the energy transfer to the said products and maintain or even increase the $\Delta T_{max}$ of these products, as illustrated in FIG. 7 of that article.

SUMMARY OF THE INVENTION

Contrary to the method described in the above article, the method according to the invention consists of the use of burners whose oxidizer has an oxygen concentration greater than 21 vol % and less than or equal to 100 vol % (hereafter called "oxy-burner"), these burners being installed in the furnace so that they are the first burners "seen" by the products to be treated as they progress through the furnace, after the latter has been charged therewith. The preheating zone formed by these oxy-burners is therefore the first preheating zone of the furnace. In the case of new furnaces, the invention therefore consists in placing oxy-burners in that zone of the furnace where the first burners have to be placed ("first" is understood to mean with regard to the direction in which the metallurgical product runs through the furnace).

The method according to the invention is characterized in that at least one burner is placed in the upstream preheating zone of the furnace, this burner being fed with an oxidizer and a fuel, the oxidizer containing more than 21 vol % and preferably more than 30 vol % oxygen. The oxidizer and fuel may be fed into the burner either by separate injection (injectors opening into the furnace) or by coaxial injection (coaxial multitube burner) or by premixing the oxidizer with the fuel before injection into the burner and then into the furnace. These various injection techniques are well known per se to those skilled in the art.

In the case of the modification of an existing furnace, the invention may comprise two implementation variants. The first variant consists in creating a new furnace zone having oxy-burners.

To do this, the oxy-burners are installed in a zone of the furnace which originally did not have any burners. By way of example, this may consist in installing oxy-burners at the end of the furnace zone called the recovery zone, just before the first heating zone which (normally has air-fuel burners).

The second variant consists in converting an existing zone, that is to say all or some of the air-fuel burners are removed from an existing preheating zone to be replaced with oxy-burners installed in the same zone.

The two variants of the above solution in existing furnaces may be implemented separately or in combination.

According to a third variant, the method according to the invention is characterized in that the proportion of oxygen in the oxidizer injected into the said oxy-fuel burner depends on the preheating temperature of the existing air-fuel burners, the proportion of oxygen being chosen so that the thermal efficiency of the said oxy-fuel burner is greater than the thermal efficiency of the existing air-fuel burners.

According to a fourth variant, the method according to the invention is characterized in that the proportion of oxygen in the oxidizer injected into the said burner is greater than or equal to 88 vol %, preferably greater than or equal to 95 vol %.

According to a fifth variant, the method according to the invention is characterized in that the oxidizer delivered to the said at least one burner is a mixture of air and industrially pure oxygen.

According to a sixth variant, the method according to the invention is characterized in that the oxidizer delivered to the said at least one burner is a mixture of air and oxygen coming from a VSA (Vacuum Swing Adsorption) system well known to those skilled in the art.

Finally, according to another aspect of the invention, the method according to the invention is characterized in that the oxidizer injected into the said at least one burner includes from 1 to 5 vol % of argon. Since the molar mass and the density of argon are higher than those of oxygen, the presence of argon in the oxygen-containing oxidizer makes it possible to increase the momentum of the flame. This increase in momentum will give a more stable flame, less sensitive to transverse flows, closer to the metallurgical product to be reheated, and it will therefore consequently provide more effective and more homogeneous heating of the product to be reheated.

BRIEF DESCRIPTION OF THE FIGURES OF THE DRAWINGS

The invention will be more clearly understood with the aid of the following illustrative examples, in conjunction with the figures which show.

DETAILED DESCRIPTION OF THE PREFERRED EMBODIMENTS

The invention may apply to various types of furnace, whether new furnaces in which the method of the invention may be applied direct, or existing furnaces which are therefore modified.

In all cases, one of the important parameters of the method according to the invention is the use of oxygen-enriched air as the oxidizer in at least some of the burners of the furnace, the oxygen concentration of which oxidizer may vary according to the intended aim. Thus, the oxygen concentration in the oxidizer may vary from more than 21 vol % to 100 vol %.

Figure 7:
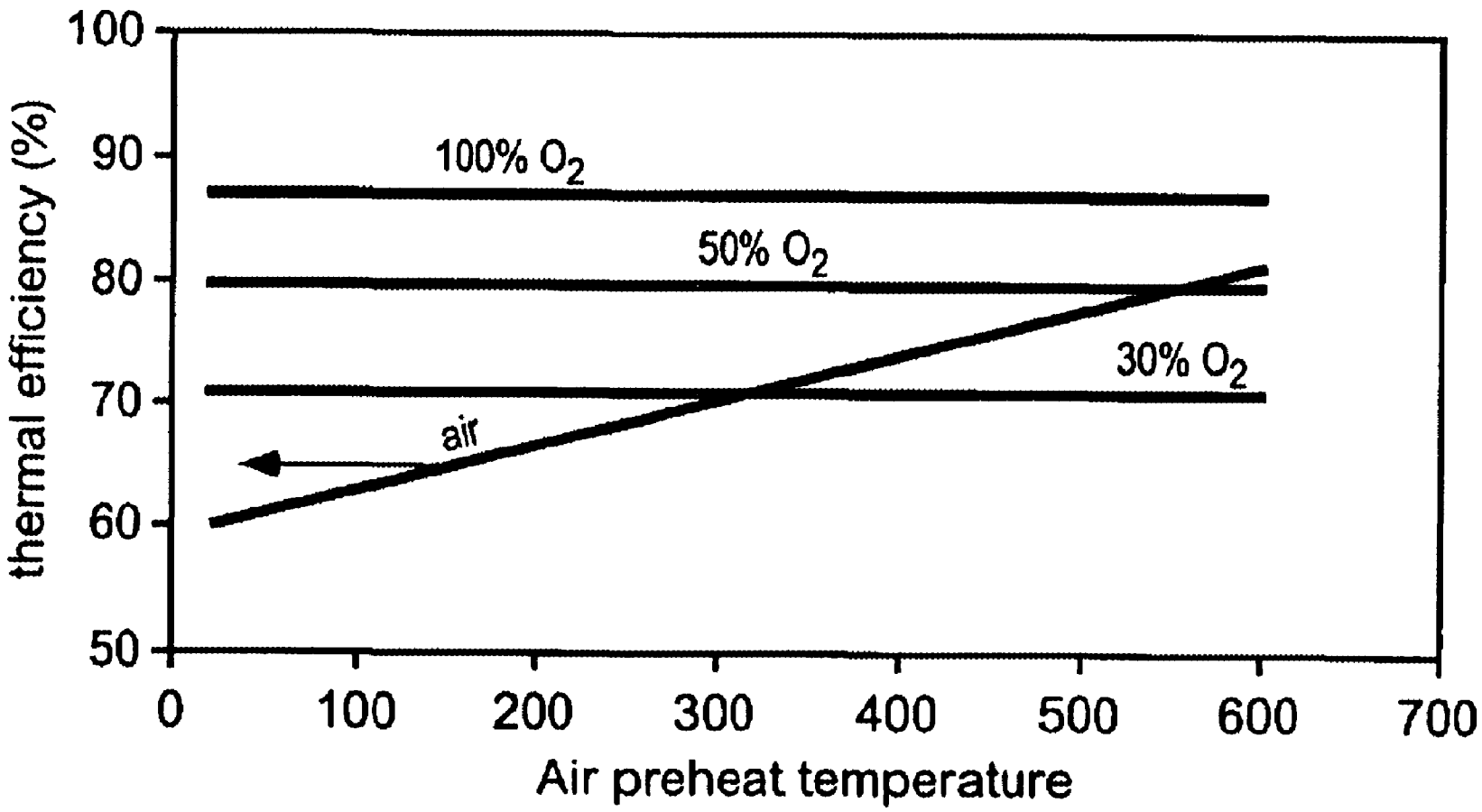
FIGS. 7 and 8, a comparison between the use of air and the use of oxygen.

When the oxygen concentration in the oxidizer is increased, this amounts to increasing the thermal efficiency of the burner using this oxidizer. Increasing the thermal efficiency of one or more burners in a reheat furnace has an impact on the furnace and its environment, particularly in terms of energy saving. FIG. 7 shows the variation in the efficiency and in the volume of the smoke as a function of parameters such as, on the one hand, the air preheat temperature and, on the other hand, the oxygen concentration. In this curve, it may be seen that whatever the air preheat temperature (when air is used as oxidizer), it is possible to find an oxygen concentration in the oxidizer which gives a higher efficiency than with combustion using air. For example, if the air preheat temperature is 300° C., any oxidizer whose $O_2$ concentration is greater than 30 vol % will give (according to FIG. 7) a higher thermal efficiency, synonymous with energy saving.

Figure 8:
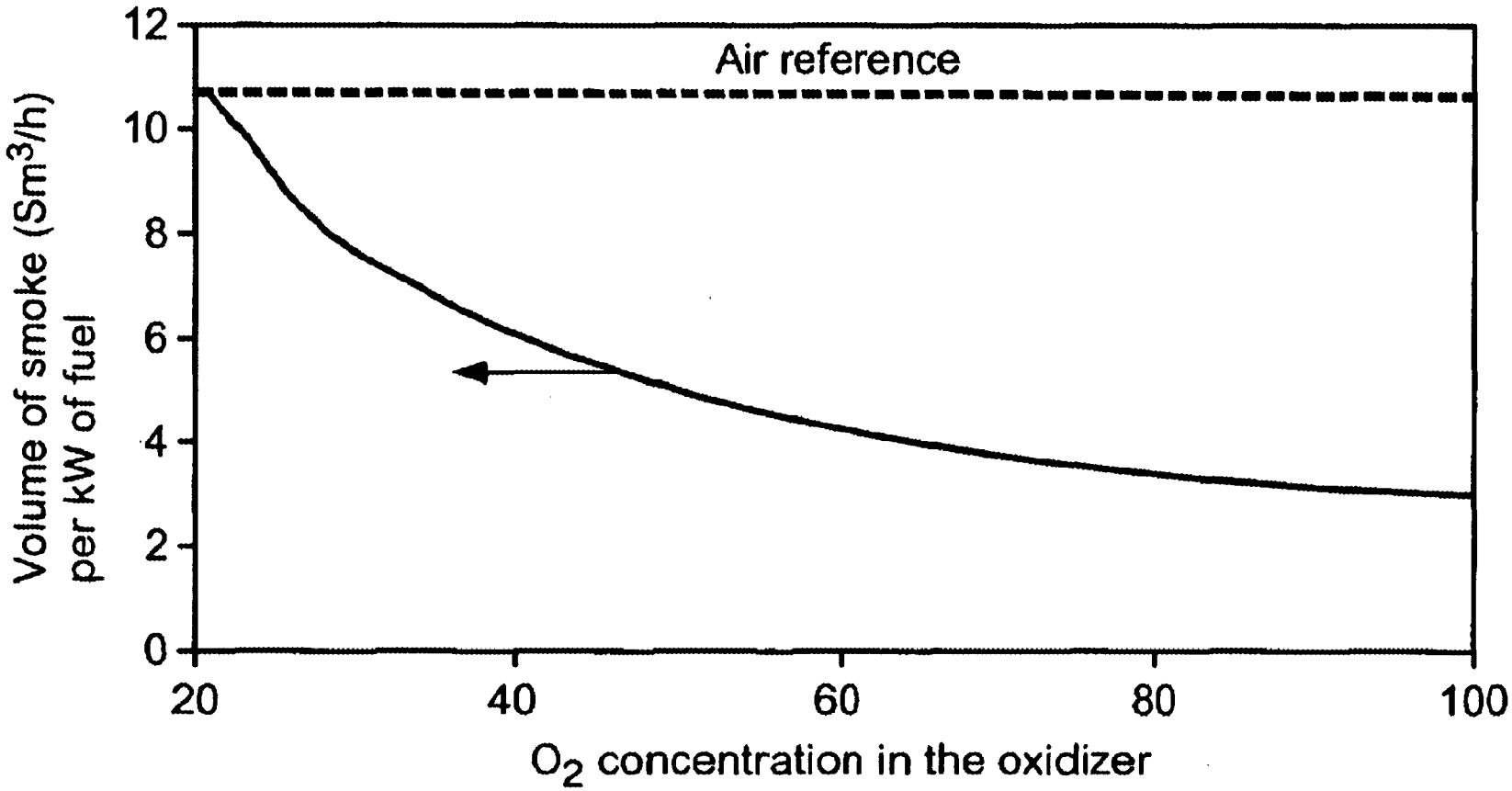

Another advantage of the invention is connected with the volume of smoke in the furnace. FIG. 8 shows the variation in the volume of smoke (in $Sm^3/h$ per kW of fuel) as a function of the oxygen concentration in the oxidizer.

The volume of smoke when air is used ("air reference" in FIG. 8) has a constant value whatever the air preheat temperature. By way of example, the use of pure oxygen as oxidizer allows the volume of flue gases (related to the combustion of 15 $m^3/h$ of natural gas) to be reduced from 10.6 to 3 $Sm^3/h$, i.e. a reduction by a factor of 3.5.

This reduction in the volume of smoke allows the recuperator to be operated more efficiently thereby allowing the "output" of the furnace to be increased, as will be explained below.

The volume of smoke in the furnace is directly linked to the pressure in the furnace (which must remain minimal)—to increase the thermal power delivered in to the furnace while keeping air as the oxidizer would effectively mean an increase in the volume of smoke in the furnace and therefore an increase in the pressure in the furnace, which in turn would run the risk of the furnace being damaged, possibly to the point of its destruction.

The invention may be implemented in various ways, depending on the objective to be achieved, these being explained below.

Constant Hourly Production

The invention is implemented, with the same output (constant hourly production of reheated metal), by installing oxy-burners in the relevant zone, making these oxy-burners operate at a given power ($P_{oxy}$) while reducing the power of the air-gas burners of the other heating zones by a power at least equal to the power of the oxy-burners $P_{oxy}$ but less than twice the power $P_{oxy}$ ($P_{oxy}$<power reduction<$2P_{oxy}$).

The power of the air-gas burners in the modified furnace is then equal to the initial (before furnace modification) air-gas power, i.e. $P_{air}^{ref}$, less $\alpha P_{oxy}$, where $1<\alpha<2$.

Figure 5:
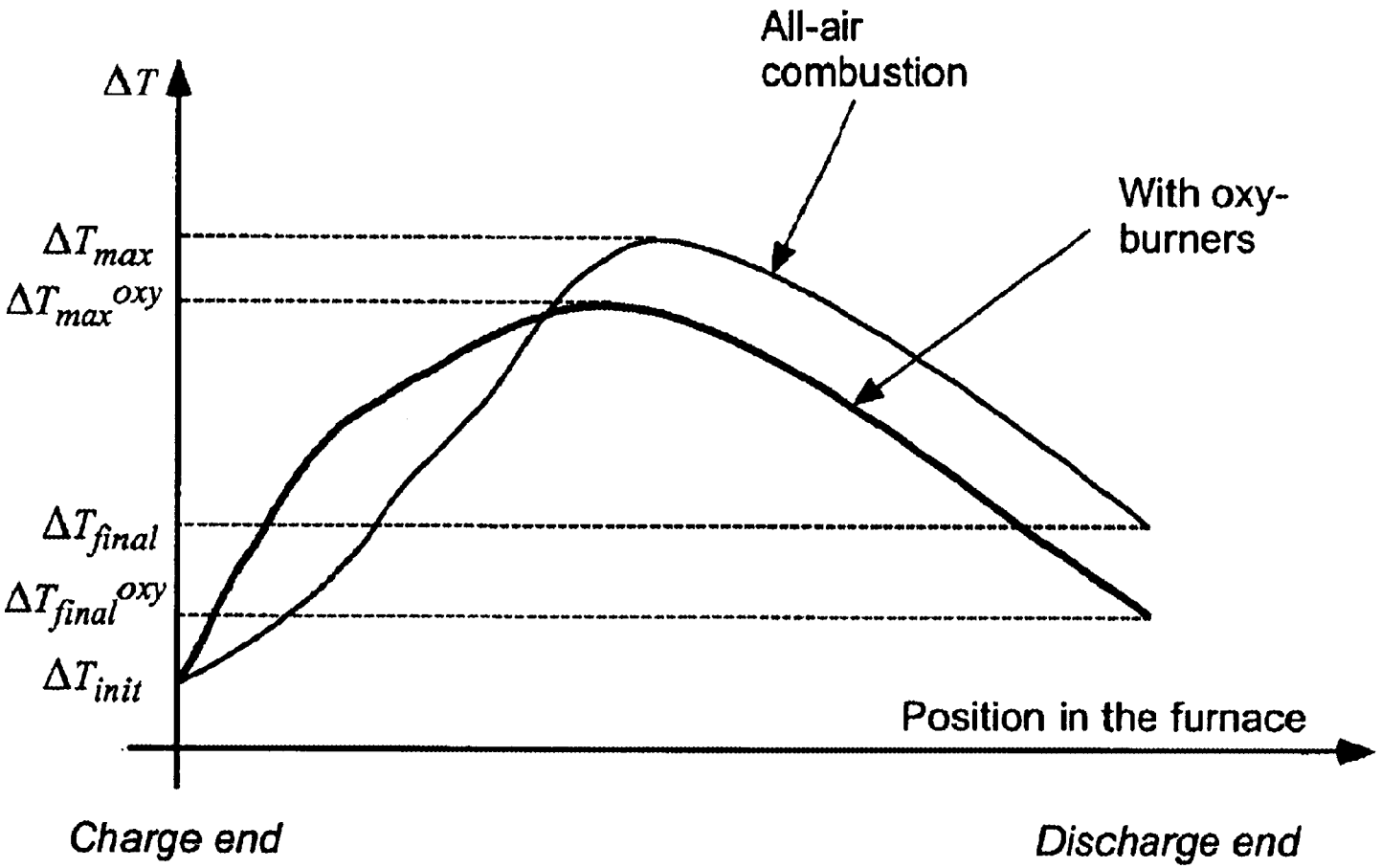
FIG. 5, an example of how the invention is implemented, showing a reduction in the consumption of fuel while maintaining a constant hourly production.

In FIG. 5, which shows the theoretical variation in $\Delta T$ between an all-air combustion and a combustion, in the same furnace, in which certain burners have been replaced with pure-oxygen burners, it may be seen that the two problems associated with the temperature difference $\Delta T$ are solved: $\Delta T_{max}$ is reduced while $\Delta T_{final}$ is also reduced.

Increase in the Hourly Production

FIG. 5 shows another consequence of the invention: it is possible to increase the hourly production while maintaining the $\Delta T_{max}$ and $\Delta T_{final}$ values as they are in the furnace using combustion with only air. This increase in hourly production may take place in two ways: either increasing the rate of discharge while maintaining the size of the reheated product or maintaining the rate of discharge and increasing the size of the reheated product.

Maintaining the Product Size

For the same product, the increase in output would result in an increase in the discharge rate. The residence time in the furnace is therefore reduced and the temperatures of the product no longer have the time to become homogeneous: $\Delta T_{max}$ and $\Delta T_{final}$ increase, making it impossible to increase the output.

Implementation of the invention allows $\Delta T_{max}$ and $\Delta T_{final}$ to be reduced and therefore again allows the output to be increased. The $\Delta T_{max}$ and $\Delta T_{final}$ values resume their initial values, but the hourly production will have been increased without additional consumption of energy.

Figure 6:
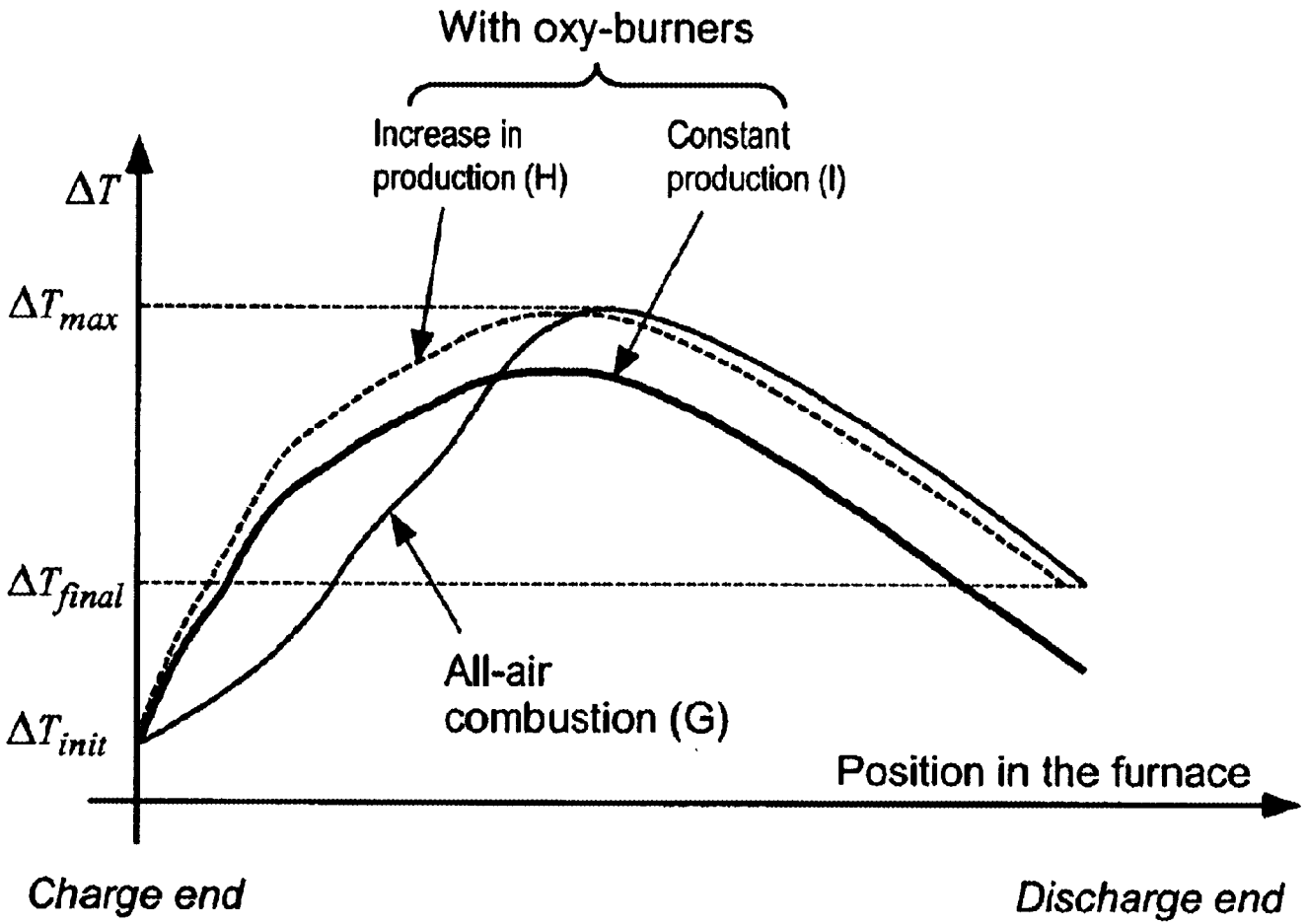
FIG. 6, an example of how the invention is implemented in which the production of the furnace is increased while maintaining the same temperature differences $\Delta T$ as during the operation before implementation of the invention.

FIG. 6 shows various theoretical possible situations with various curves: $\Delta T$=f (position of the product in the furnace).

Curve G shows the case of combustion with 100% air (existing furnace), curve H shows the same furnace fitted with oxy-fuel burners allowing the production to be increased, and curve I shows the same furnace fitted with oxy-fuel burners allowing constant production to be maintained but with a reduction in $\Delta T_{max}$ and $\Delta T_{final}$.

Increase in the Product Size

Another way of increasing the hourly production is to increase the product size for a constant discharge rate. The consequences are the same as those described above. When the product size increases, the characteristic conduction time is modified and the temperature differences are therefore exacerbated; $\Delta T_{max}$ and $\Delta T_{final}$ increase if the combustion takes place only with air. Implementation of the invention again makes it possible firstly to reduce these values, and therefore to treat (reheat) products of larger size.

EXAMPLE 1

Figure 1:
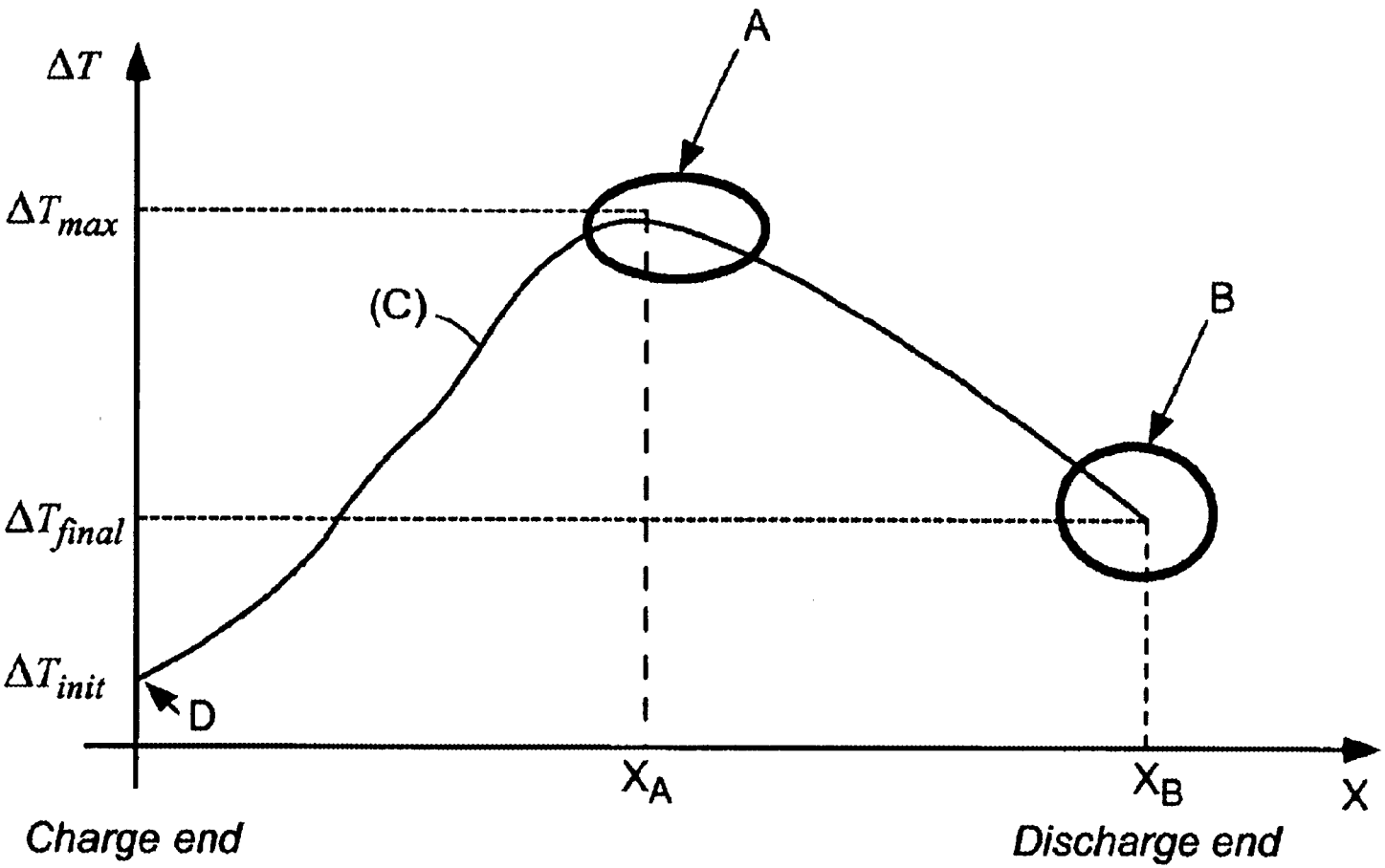
FIG. 1, the position of the product in the furnace has been plotted on the x-axis and the $\Delta T$ value on the y-axis
Figure 2:
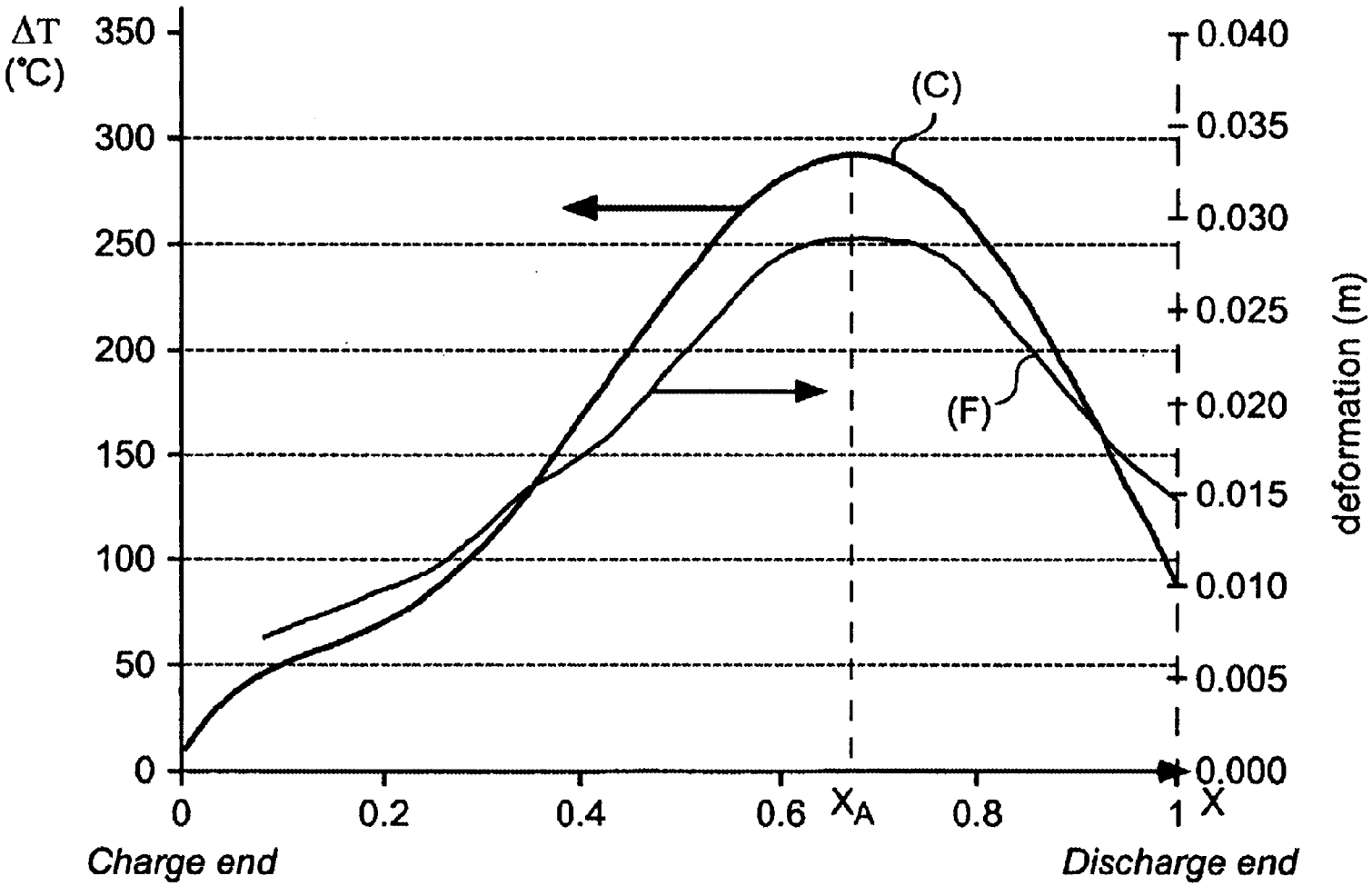
FIG. 2, illustrates the relationship between the temperature difference $\Delta T$ and the sag.
Figure 3:
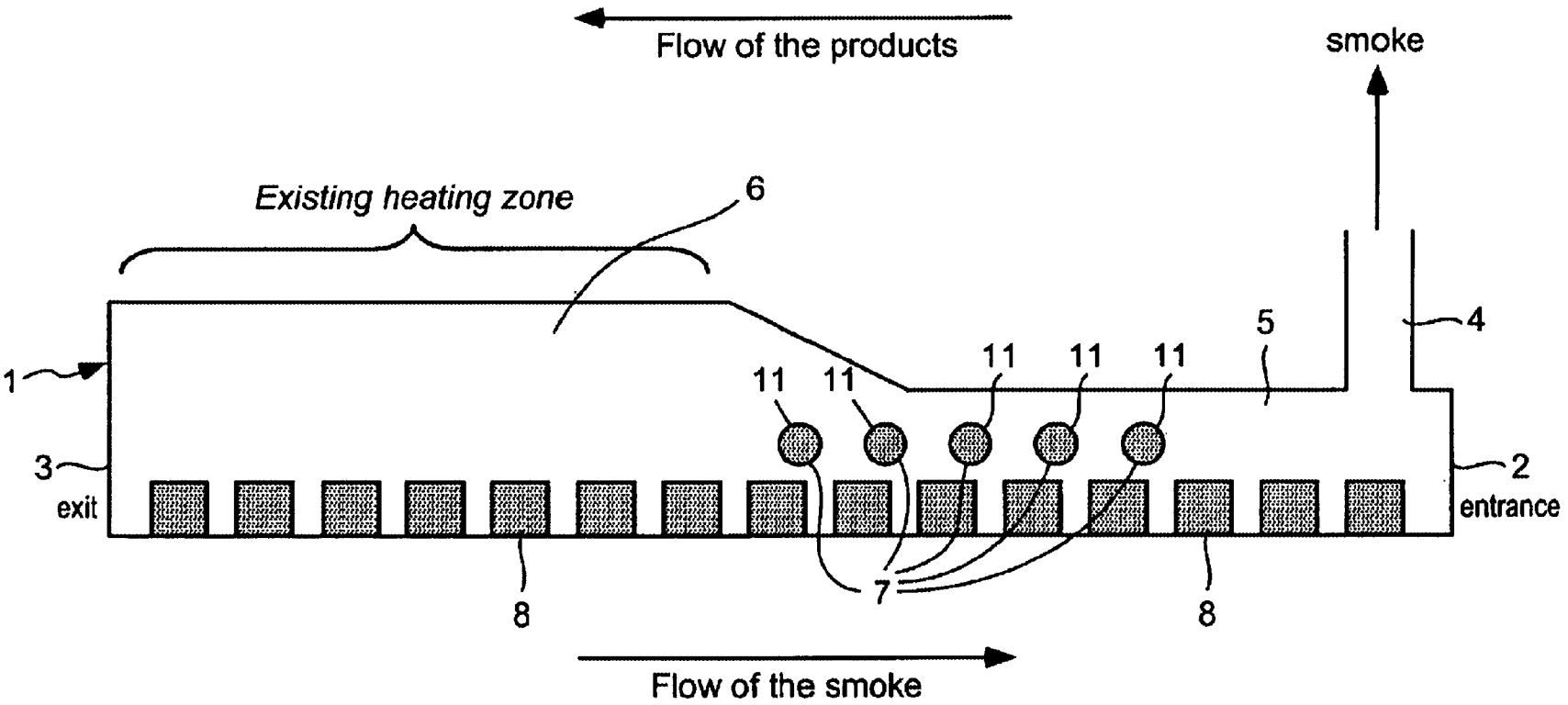
FIG. 3, an example of how the invention is implemented in a billet reheat furnace.

FIG. 3 shows the implementation of the invention in a walking hearth furnace 1 for billets, the furnace having a power of about 30 MW and an output of 92 t/h. The furnace consists of an upstream zone 5 constituting the first half of the furnace and a downstream half 6 occupying the second half of the furnace.

The products 8 enter the furnace 1 via the entrance 2 and move, from right to left in the figure, towards the exit 3. The air-fuel burners of the downstream zone 6 have been retained, while several oxy-fuel burners 11 have been installed over about half the upstream zone 5 (the half closer to the downstream zone 6). The smoke flows from the exit towards the entrance as a countercurrent to the products 8, which are thus preheated by being in contact with it. The smoke is extracted via the flue 4.

The following results were obtained on this furnace

| | Reference (air-combustion) | Furnace according to the invention (with oxy-combustion) | |
|---|---|---|---|
| Production (t/h) | 92 | 100 | 110 |
| Fuel power | 30 MW air-comb | 26 MW air-comb + 4 MW oxy-burner | 30 MW air-comb + 4 MW oxy-burner |
| $\Delta T$ | 50° C. | −50% (25° C.) | −20% (40° C.) |

Thus, for the same power consumed, with four oxy-fuel burners uniformly spaced over the downstream half of the upstream zone, the half closer to the first existing air-fuel heating zone (or downstream zone of the furnace), an increase in output of about 10% is achieved and the $\Delta T$ coefficient is reduced by 50%, while an increase of 20% in the output makes it possible nevertheless to lower the value of the $\Delta T$ coefficient of the products by about 20%.

Moreover, for a total production cost of 100 in the reference (air) case for an output of 92 tonnes/hour (including the costs of reheating and rolling the product), a cost of 88 is obtained for the case of an output of 110 t/h using oxygen, i.e. a 12% saving in the overall cost per tonne of finished product (for example, saleable rolled product). Furthermore, the NOx in the smoke emitted by the furnace is reduced by 10 to 20% depending on the case.

Figure 9:
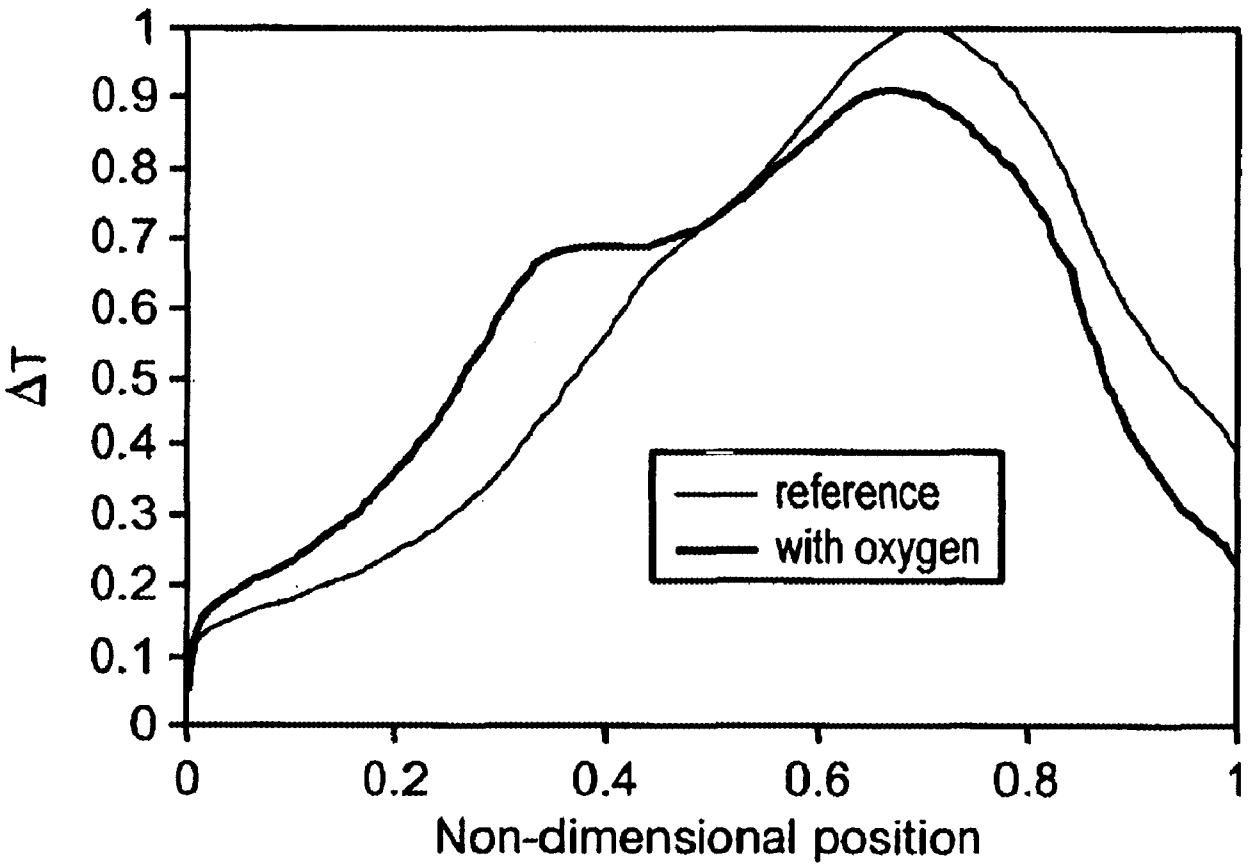
FIG. 9, an illustration of the implementation of the invention according to FIG. 3.

FIG. 9 shows an experimental curve of ΔT=f (position in the furnace) in the case of the furnace according to the invention described above. This FIG. 9 is very similar to FIG. 5.

EXAMPLE 2

Figure 4A:
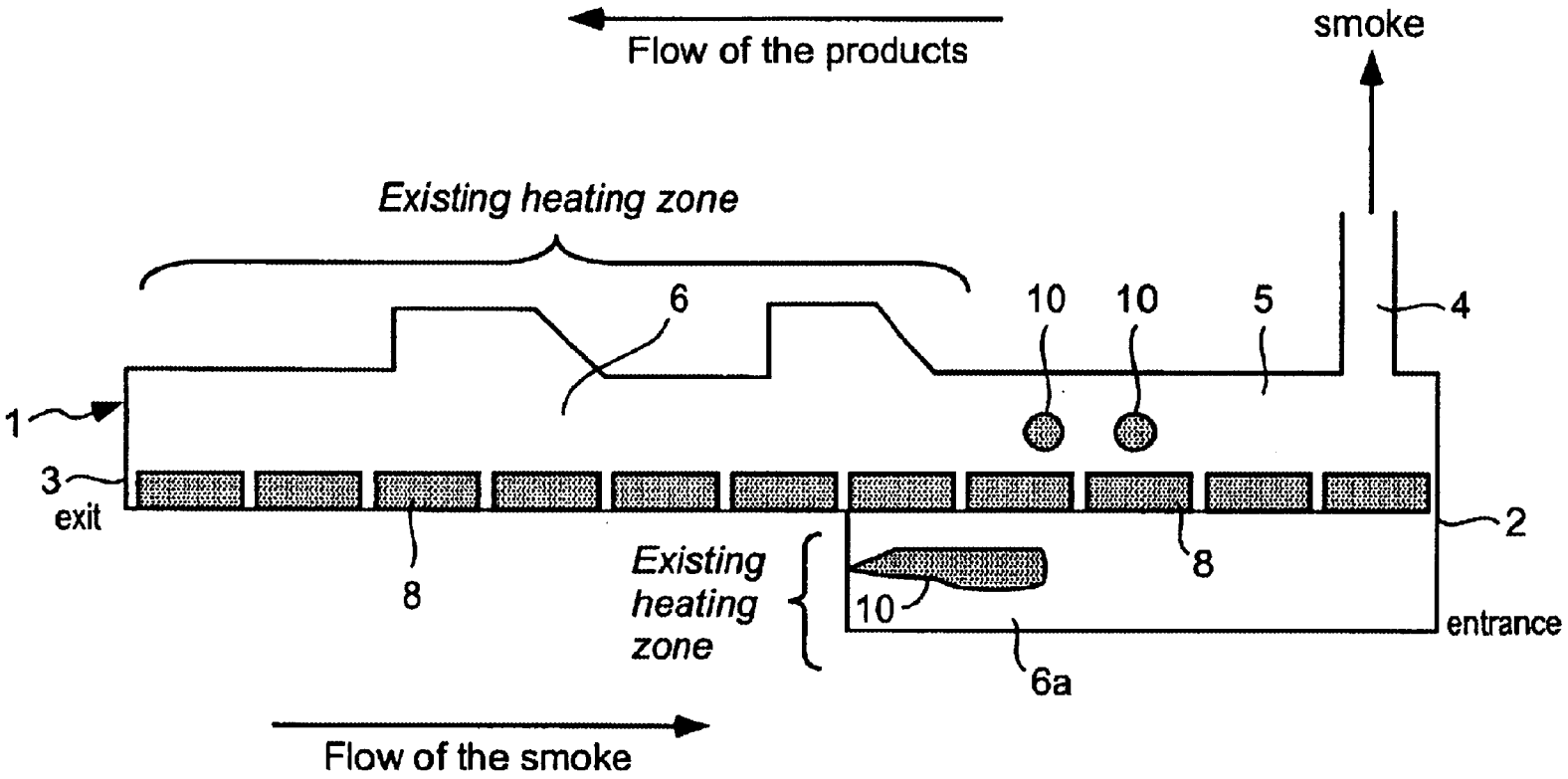
FIG. 4, an example of how the invention is implemented in a slab reheat furnace.
Figure 4B:
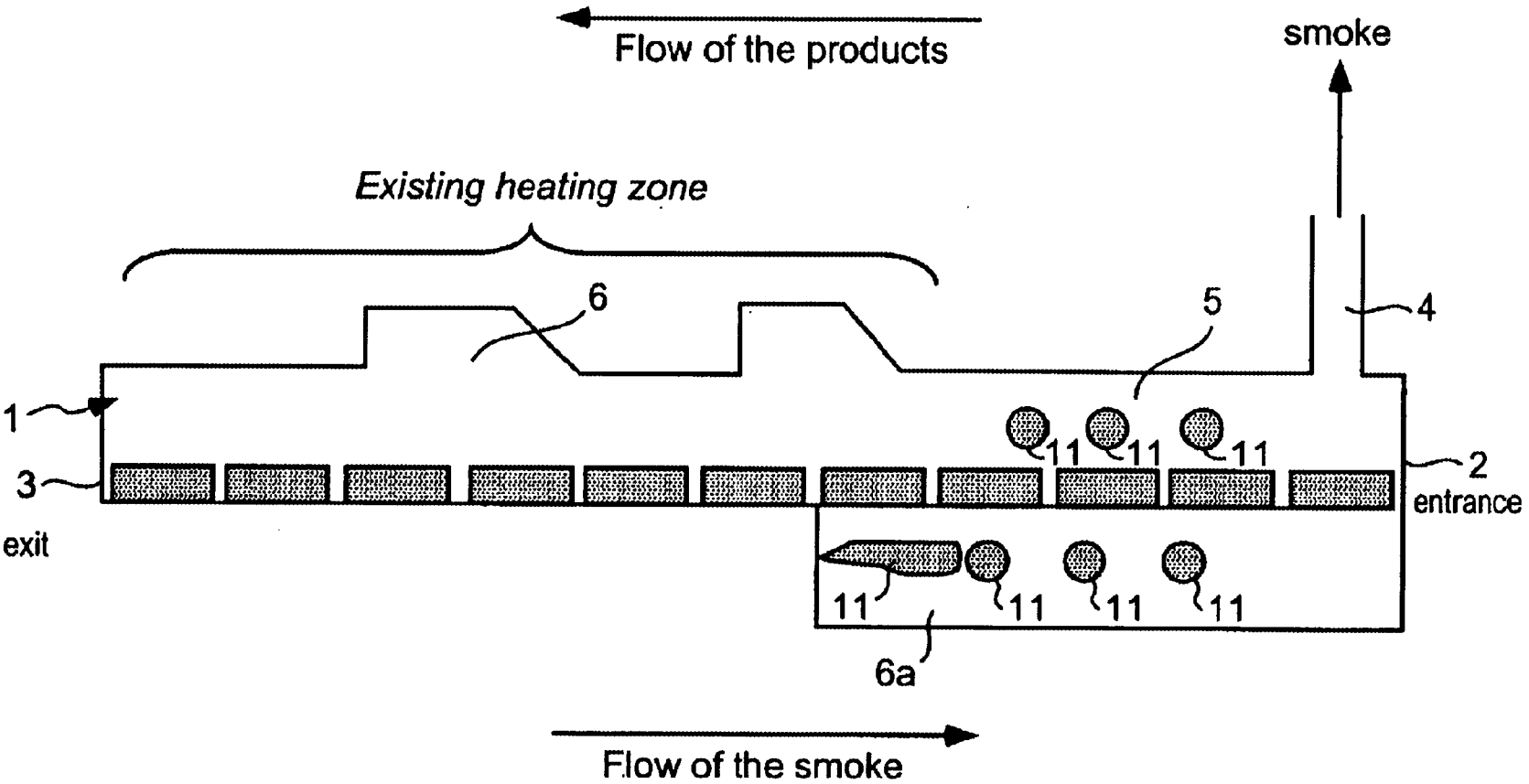

FIG. 4 shows another example of implementation of the invention in a slab reheat furnace. In FIG. 4, the same components as those in FIG. 3 bear the same reference numbers. In this type of existing furnaces (FIG. 4*a*), the upstream zone 5 of the furnace already includes a heating zone 6, fed by air-gas burners, in the arrangement shown in FIG. 4*a*. By replacing the burners 10 (FIG. 4*a*) with burners 11 (FIG. 4*b*), a reduction in the ΔT of the products of around 30% is again observed, for an increase in the output possibly up to 50% if the total power consumed is maintained. The arrangement of the burners 11 follows the rules expounded above in the case of the installation of the oxy-fuel burners.

What is claimed is:

1. Method of reheating metallurgical products, in which solid products are reheated so as to bring them from a temperature substantially below 400° C. to a temperature of at least about 1000° C. by passing them through a furnace having an upstream zone in which said products are preheated and a downstream zone in which said products are brought to their final temperature on leaving the furnace, the downstream zone of the furnace being fitted with burners, at least some of which operate with an oxidizer which is air, the flue gases generated by these burners flowing as a countercurrent to the products and preheating these products in the upstream preheating zone, wherein at least one oxy-fuel burner is placed in the upstream preheating zone of the furnace, this burner being fed with an oxidizer and a fuel, the oxidizer containing more than 21 vol % oxygen.

2. Method according to claim 1, in which an existing furnace is modified, wherein said oxy-fuel burner located in the upstream zone of the furnace is installed at a point which initially did not have a burner.

3. Method according to claim 1, in which an existing furnace is modified, wherein said oxy-fuel burner replaces one or more existing air-fuel burners.

4. Method according to claim 1, wherein the proportion of oxygen in the oxidizer injected into said oxy-fuel burner is chosen according to the combustion air preheat temperature of the existing air-fuel burners.

5. Method according to claim 1, wherein the proportion of oxygen in the oxidizer injected into said oxy-fuel burner is greater than or equal to 88 vol %.

6. Method according to claim 1, wherein the oxidizer delivered to said oxy-fuel burner is a mixture of air and industrially pure oxygen.

7. Method according to claim 1, wherein the oxidizer delivered to said oxy-fuel burner is a mixture of air and oxygen coming from a VSA unit.

8. Method according to claim 1, wherein the oxidizer injected into said oxy-fuel burner includes about 1 to 5 vol % of argon.

9. Method according to claim 2, in which an existing furnace is modified, wherein said oxy-fuel burner replaces one or more existing air-fuel burners.

10. Method according to claim 2, wherein the proportion of oxygen in the oxidizer injected into said oxy-fuel burner is chosen according to the combustion air preheat temperature of the existing air-fuel burners.

11. Method according to claim 3, wherein the proportion of oxygen in the oxidizer injected into said oxy-fuel burner is chosen according to the combustion air preheat temperature of the existing air-fuel burners.

12. Method according to claim 2, wherein the proportion of oxygen in the oxidizer injected into said oxy-fuel burner is greater than or equal to 88 vol %.

13. Method according to claim 3, wherein the proportion of oxygen in the oxidizer injected into said oxy-fuel burner is greater than or equal to 88 vol %.

14. Method according to claim 4, wherein the proportion of oxygen in the oxidizer injected into said oxy-fuel burner is greater than or equal to 88 vol %.

15. Method according to claim 2, wherein the oxidizer delivered to said oxy-fuel burner is a mixture of air and industrially pure oxygen.

16. Method according to claim 3, wherein the oxidizer delivered to said oxy-fuel burner is a mixture of air and industrially pure oxygen.

17. Method according to claim 4, wherein the oxidizer delivered to said oxy-fuel burner is a mixture of air and industrially pure oxygen.

18. Method according to claim 5, wherein the oxidizer delivered to said oxy-fuel burner is a mixture of air and industrially pure oxygen.

19. Method according to claim 2, wherein the oxidizer delivered to said oxy-fuel burner is a mixture of air and oxygen coming from a VSA unit.

20. Method according to claim 3, wherein the oxidizer delivered to said oxy-fuel burner is a mixture of air and oxygen coming from a VSA unit.

21. Method according to claim 4, wherein the oxidizer delivered to said oxy-fuel burner is a mixture of air and oxygen coming from a VSA unit.

22. Method according to claim 5, wherein the oxidizer delivered to said oxy-fuel burner is a mixture of air and oxygen coming from a VSA unit.

23. Method according to claim 6, wherein the oxidizer delivered to said oxy-fuel burner is a mixture of air and oxygen coming from a VSA unit.

24. Method according to claim 2, wherein the oxidizer injected into said oxy-fuel burner includes about 1 to 5 vol % of argon.

25. Method according to claim 3, wherein the oxidizer injected into said oxy-fuel burner includes about 1 to 5 vol % of argon.

26. Method according to claim 4, wherein the oxidizer injected into said oxy-fuel burner includes about 1 to 5 vol % of argon.

27. Method according to claim 5, wherein the oxidizer injected into said oxy-fuel burner includes about 1 to 5 vol % of argon.

28. Method according to claim 6, wherein the oxidizer injected into said oxy-fuel burner includes about 1 to 5 vol % of argon.

29. Method according to claim 7, wherein the oxidizer injected into said oxy-fuel burner includes about 1 to 5 vol % of argon.

30. Method according to claim 1, wherein the solid products comprise steel products.

31. Method according to claim 1, wherein the oxidizer contains more than 30 vol % oxygen.

32. Method according to claim 5, wherein the proportion of oxygen in the oxidizer injected into said oxy-fuel burner is greater than or equal to 95 vol %.

33. Method according to claim 12, wherein the proportion of oxygen in the oxidizer injected into said oxy-fuel burner is greater than or equal to 95 vol %.

34. Method according to claim 13, wherein the proportion of oxygen in the oxidizer injected into said oxy-fuel burner is greater than or equal to 95 vol %.

35. Method according to claim 14, wherein the proportion of oxygen in the oxidizer injected into said oxy-fuel burner is greater than or equal to 95 vol %.

* * * * *